United States Patent [19]

Bassett

[11] Patent Number: 4,475,579

[45] Date of Patent: Oct. 9, 1984

[54] VENETIAN BLIND ASSEMBLY

[76] Inventor: Robert F. Bassett, 126 Grandview Ter., Batavia, N.Y. 14020

[21] Appl. No.: 432,197

[22] Filed: Oct. 1, 1982

[51] Int. Cl.[3] ..... E06B 9/38

[52] U.S. Cl. ..... 160/178 R; 160/236

[58] Field of Search ..... 160/178 R, 172, 236

[56] References Cited

U.S. PATENT DOCUMENTS

| | | | |
|---|---|---|---|
| 2,317,917 | 4/1943 | Kasan | 160/236 |
| 2,837,152 | 6/1958 | Moore, Jr. | 160/236 |
| 3,106,240 | 10/1963 | Weker | 160/236 |

FOREIGN PATENT DOCUMENTS

| | | | |
|---|---|---|---|
| 287277 | 1/1967 | Australia | 160/178 R |
| 982256 | 2/1965 | United Kingdom | 160/178 R |

*Primary Examiner*—Peter M. Caun

*Attorney, Agent, or Firm*—Martin LuKacher

[57] ABSTRACT

A venetian blind assembly having slats of flexible material which are removably mounted in brackets. The brackets have grooves into which opposite side edges of the slats are received. There are stops which limit the insertion of the ends of the slats into the brackets. The brackets and slats also have detents which connect the brackets and slats, to each other and which may be released by deflecting the slats causing the portion of the detent therein to clear the bracket. The slat then can be pulled out of the bracket for cleaning or replacement. The brackets are also assembled in vertically stacked relationship by cords which are threaded through apertures of adjacent brackets and run around the edge of and over a side of the brackets. Hooks are provided for retaining the cords on the sides of the brackets.

10 Claims, 2 Drawing Figures

VENETIAN BLIND ASSEMBLY

DESCRIPTION

The present invention relates to venetian blinds and particularly to an assembly of slats and brackets which enables the slats readily to be released from the brackets so that they may be cleaned or replaced. The assembly also provides an arrangement of cords for the removal of brackets and slats from a venetian blind or the addition of brackets and slats; thus permitting shortening or lengthening the blind as may be desired.

Heretofore there have not been available venetian blinds in which the slats are easily removable or replacable; nor have there been venetian blinds which can readily be shortened without complete reconstruction or reassembly, which involves restringing tapes through all of the slats in the assembly. An attempt to provide removable slats for venetian blinds has necessitated a special slat construction which is difficult and expensive to manufacture. Moreover, the construction does not facilitate lengthening or shortening of the assembly since it still requires conventional tapes to hold the slats (see Wolfe, U.S. Pat. No. 3,086,586 issued Apr. 23, 1963).

Accordingly, it is an object of the present invention to provide an improved venetian blind assembly.

It is another object of the present invention to provide an improved venetian blind assembly having removable slats which may readily be connected and disconnected from the assembly for cleaning or replacement or other maintenance activity.

It is a still further object of the present invention to provide an improved venetian blind assembly which does not rely on tapes to hold the slats in vertically stacked relationship and which enables the blinds to be lengthened or shortened by the removal of slats without complete reconstruction of the venetian blind.

The foregoing and other objects, features and advantages of the invention will become more apparent from a reading of the following description in connection with the accompanying drawings in which.

Figure 1:
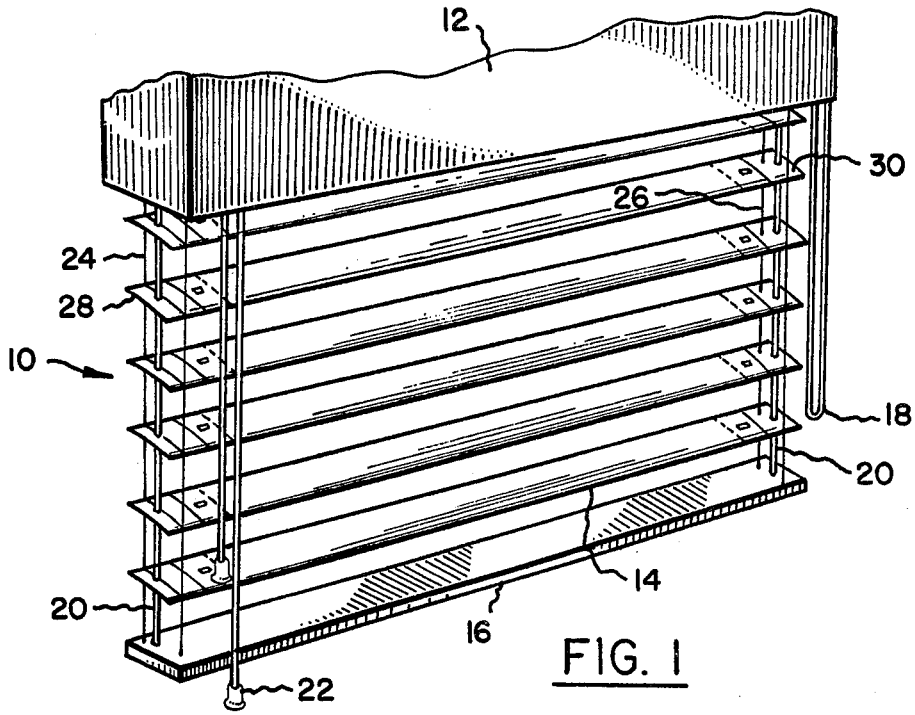
FIG. 1 is a perspective view illustrating a venetian blind assembly embodying the invention.

Referring to FIG. 1, there is shown a venetian blind assembly 10 having a casing 12 containing the mechanism for raising and lowering as well as tilting a plurality of slats 14 and a bottom bar 16. A cord 18 operates the mechanism in the casing 12 for raising and lowering lines 20 to raise and lower the blind 10.

Other cords 22 are connected to mechanisms in the casing 12 for tilting an assembly of cords 24 and 26 which hold the slats 14 in vertically stacked relationship. The raising and lowering and tilting mechanisms may be of conventional design. The cords 24 and 26 are assembled to brackets 28 and 30 which are located at the ends of each of the slats 14. It will be appreciated that if the slats are very long an additional arrangement of brackets and associated supporting cords may be provided to support opposed ends of separate pairs of slats which are used instead of single slats as shown in FIG. 1.

Figure 2:
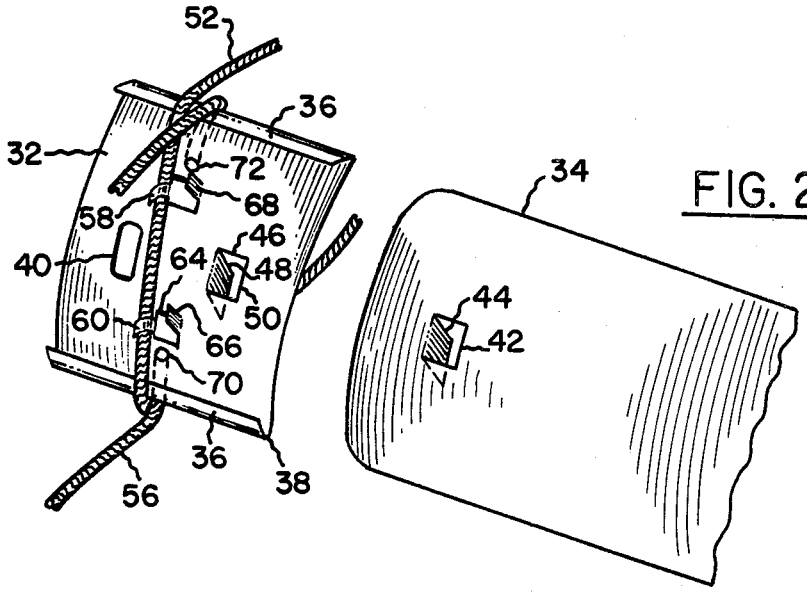
FIG. 2 is a fragmentary, perspective view illustrating, enlarged and in greater detail, a typical bracket and slat of the venetian blind assembly shown in FIG. 1.

A typical one of the brackets 28 and 30, which is identified by reference numeral 32, and a typical one of the slats 14 which is identified by reference numeral 34 are shown in FIG. 2. Both the brackets and the slats may be made of sheet metal. The slat is desirably made of resilient flexible material. Plastic as well as sheet metal may be suitable; however, fabrication of the brackets and slats from sheet metal may be accomplished at lower costs especially in low volume production. It is important that the slats be of flexible resilient material to allow them to be deflected by squeezing opposite side edges thereof. The bracket 32 has its side edges 36 folded over to form grooves 38 along each of the side edges 36. These folds also increase the strength of the bracket by stiffening it. The brackets also have an elliptical opening 40 to which the lines 20 extend and provide sufficient clearance for the tilting of the slat and their associated brackets. The slats are received with their edges in the grooves 38. In order to releasably connect the slats and the brackets so as to facilitate removal of the slats from the brackets, a detent mechanism is provided. This detent mechanism is in the form of a hole 42 in the slat 34 near the end thereof. Of course, two sets of holes and two sets of detent mechanisms are provided in each slat 34, each near the opposite end thereof. The hole 42, formed by punching out, leaves a flap or projection 44 which functions as the latch of the detent mechanism. In the bracket 32 there is formed in alignment with the slat 44, as along the center line of the bracket which is coincident with the center line of the slat 34, another hole 46. This hole may be formed by punching out and leaves a flap 48. The flap 48 may be left in place. However, it may be removed if desired. The edge 50 of the hole 46 provides a catch of the detent mechanism. The flap 44 latches over the edge 50 and falls into the hole 46, where it is retained. In order to release the slat 34, it may merely be deflected and curved so as to enable the flap 44 to raise over the surface of the bracket 32. It will be noted that the curvature and cross sections between the side edges of both the slat 34 and the bracket 32 are complimentary. It further will be noted that the vertical height of the flap 44 is such that it provides positive detent action while at the same time being sufficiently closely spaced to the side surface of the slat 34 to enable it to clear the side surface of the bracket 32 in order to be removed from the bracket. In other words, merely by squeezing the slats at the sides thereof near the bracket, removal of the slats from the brackets may be facilitated.

The brackets remain in place; being held there by the cords 24 (see FIG. 1). A pair of such cords are assembled on each bracket. A typical one of such pairs of cords is illustrated as the cords 52 and 56 in FIG. 2. Tabs 58 and 60 are formed in the brackets 32, preferably on the punching out of holes 62 and 64. At the same time that the tabs 58 and 60 are formed, there are also formed stop tabs or flaps 66 and 68. These stop tabs are in spaced relationship to the hole 46, which provides part of the detent mechanism holding the slats releasably in the brackets. Accordingly, when the end of the slat 34 is inserted into the grooves 38, the end of the slat 34 comes in contact with the stop tabs 66 and 68 when the flap 44 is precisely located in the hole 46. This facilitates fool-proof assembly of the slats 34 and the brackets 32.

Apertures 70 and 72 are also provided in the brackets connected to the holes 62 and 64 by keyways or slots.

The cords 56 which come from a bracket disposed adjacent to the bracket 32, spaced vertically above the bracket 32, extend around the edges 36 of the bracket and may be brought through the keyway into the apertures 70 and 72. The ends of these cords may be knoted or otherwise enlarged so as not to fall through the apertures 70 and 72. As may be seen from the location of the cord 52, it corresponds to the cord 56 in the bracket which is spaced vertically above the bracket 32. The cord 52 extends over the side surface of the bracket 32 underneath the tabs 58 and 60. When the bracket 32 is made of sheet metal, the tabs 58 may be crimped so as to firmly hold the cord 52 in place. The cord 52 then extends to the bracket immediately below the bracket 32 and into the apertures corresponding to the apertures 70 and 72. It will be seen that the length of the venetian blind assembly may readily be lengthened or shortened merely by removal of the cords, preferably at the slat and brackets nearest the bar 16. Then additional slats, brackets and cords, such as the cords 52 and 56 are used, for each additional set of brackets and slats which is to be added. Similarly as many sets of brackets and slats and their supporting cords, such as the cords 52 may be removed when the blind assembly 10 is to be shortened.

From the foregoing description it will be apparent there has been provided an improved venetian blind assembly. Variations and modifications in the herein described assembly, within the scope of the invention, will undoubtedly suggest themselves to those skilled in the art. Accordingly the foregoing description should be taken as illustrative and not in a limiting sense.

I claim:

1. A venetian blind assembly which comprises a plurality of flexible, resilient slats and a plurality of brackets, at least one pair of said brackets being provided for each of said slats, said brackets each having grooves confined along the edges thereof for receiving the edges of different ones of said slats, and detent means with a catch and a latch in the opposing sides of said brackets and slats, respectively, which cooperate with each other with said latch latching over and into said catch to releasably connect said brackets and slats each to the other upon inserting said slat into said grooves until said latch latches over and into said catch to engage each said bracket and slat and by deflecting said slats and releasing said latch and catch to release each said slat from the bracket engaged therewith.

2. The assembly as set forth in claim 1 wherein detent means comprises flaps in each of said slats projecting from said slats to form holes therein, said flaps and holes being disposed near opposite edges of said slats and providing latching projections of said detent means, and said brackets having holes which receive said flaps when the ends of said slats are inserted into said grooves, said flaps being of length sufficient to allow clearance thereof from said holes and said slats are deflected to increase the curvature between the edges thereof so as to release said slats from said brackets.

3. The assembly as set forth in claim 1 wherein said brackets each have at least one additional flap projecting from said bracket and space from said hole in said bracket to present a stop for an end of said slat for locating said latch and catch of detent means in said bracket and slat with respect to each other.

4. The assembly according to claim 3 wherein said slats and brackets are of sheet metal and are rectangular in shape, said grooves being provided by folds along the side edges of said brackets, said brackets and slats each have complimentary curvatures in cross section between the edges thereof.

5. The assembly according to claim 1 wherein said brackets have tabs forming hooks and having at least one aperture, said aperture and tabs being disposed in the sides of said brackets, and a plurality of flexible members connecting said brackets and slats and extending over said sides and under said tabs.

6. The assembly according to claim 5 wherein said tabs are portions of the sides of said members extending into said aperture, said tabs being bent back from said sides of said aperture and crimped over said flexible member.

7. A venetian blind assembly which comprises a plurality of flexible, resilient slats at a plurality of brackets, at least one pair of said brackets being provided in each of said slats, said brackets each having grooves for receiving the edges of different ones of said slats, detent means in said brackets and slats which cooperate with each other to releasably connect said brackets and slats to each other, said brackets having tabs forming hooks and apertures, said apertures and tabs being disposed in the sides of said brackets, and a plurality of cords connecting said brackets and slats in vertically stacked spaced relationship, each of said cords extending over the sides of a separate one of said brackets and under said tabs and around the edges and under the sides of an adjacent one of said brackets, the ends of said cords being disposed in different ones of said apertures, and said ends of said cords being retained in said apertures.

8. The assembly according to claim 7 wherein said brackets are of sheet metal and said tabs are crimped to retain said cords.

9. The assembly according to claim 7 wherein said ends of said cords are enlarged with a diameter greater than that of said aperatures.

10. The assembly as set forth in claim 7 wherein pairs of holes are provided in said brackets, said tabs projecting as flaps from edges of said holes, said apertures being connected to said holes by keyways to facilitate insertion of said cords into said apertures.

* * * * *